US006393664B1

(12) United States Patent
Habegger et al.

(10) Patent No.: US 6,393,664 B1
(45) Date of Patent: May 28, 2002

(54) COMPRESSION SPRING HINGE MECHANISM

(75) Inventors: Jeffrey D. Habegger, Wadsworth; Steven O. Cummins, Mansfield, both of OH (US)

(73) Assignee: Mansfield Assemblies Co., Mansfield, OH (US)

( * ) Notice: Subject to any disclaimer, the term of this patent is extended or adjusted under 35 U.S.C. 154(b) by 0 days.

(21) Appl. No.: 09/657,964

(22) Filed: Sep. 8, 2000

Related U.S. Application Data

(60) Provisional application No. 60/153,379, filed on Sep. 10, 1999.

(51) Int. Cl.[7] ..... E05D 11/10

(52) U.S. Cl. ..... 16/335; 16/334; 16/228

(58) Field of Search ..... 16/335, 281, 284, 16/334, 322, 321, 297, 228; 220/326, 315, 832–836

(56) References Cited

U.S. PATENT DOCUMENTS

| | | | | | |
|---|---|---|---|---|---|
| 307,593 | A | | 11/1884 | Robinson | |
| 938,952 | A | | 11/1909 | Berg | |
| 1,094,153 | A | | 4/1914 | Krentler | |
| 1,159,529 | A | | 11/1915 | Parizek | |
| 2,268,977 | A | | 1/1942 | Westrope | |
| 2,465,088 | A | | 3/1949 | Gussack | |
| 3,644,023 | A | * | 2/1972 | Villani | 16/228 |
| 3,691,788 | A | * | 9/1972 | Mazziotti | 16/334 |
| 3,837,735 | A | * | 9/1974 | Guillet | 16/228 |
| 3,851,354 | A | | 12/1974 | Anderson | |
| 3,957,360 | A | * | 5/1976 | Villani | 16/228 |
| 4,184,228 | A | | 1/1980 | Lautenschlager et al. | |
| 4,244,081 | A | * | 1/1981 | Beyer et al. | 16/228 |
| 4,424,606 | A | * | 1/1984 | Sorimachi | 16/332 |
| 4,884,317 | A | * | 12/1989 | Liu | 16/325 |
| 5,412,842 | A | | 5/1995 | Riblett | |
| 5,515,575 | A | * | 5/1996 | Pinazza | 16/228 |
| 5,815,899 | A | * | 10/1998 | Chao | 16/228 |
| 5,867,871 | A | | 2/1999 | Tasman | |

* cited by examiner

*Primary Examiner*—Chuck Y. Mah
(74) *Attorney, Agent, or Firm*—Fay, Sharpe, Fagan, Minnich & McKee, LLP

(57) ABSTRACT

A hinge assembly includes a body adapted for connection to a first structure. A resilient member is in contact with the body, and a cam is pivotally movable relative to the body and adapted for connection to a second structure. An actuating member is positioned between the resilient member and the cam and biased by the resilient member into contact with the cam so that the actuating member exerts a force on said cam. The body defines a cylindrical bore and the resilient member is provided by a coil spring positioned in the bore. The actuating member is provided by a spherical ball member and the cam defines a lobe portion and a recessed dwell region. The cam is adapted for movement between first and second operative positions. When in the first operative position, the lobe portion of the cam is engaged with the actuating member. The lobe portion is defined so that, when the cam is in its first operative position, the actuating member urges the cam toward its second operative position. When the cam is moved to its second operative position, the actuating member and the recessed cam portion provide a detent mechanism that holds the cam in the second operative position.

6 Claims, 2 Drawing Sheets

COMPRESSION SPRING HINGE MECHANISM

Cross-Reference to Related Application

This application claims priority from and hereby expressly incorporates by reference U.S. provisional application Ser. No. 60/153,379 filed Sep. 10, 1999.

BACKGROUND OF THE INVENTION

The present invention relates to a hinge mechanism and, more particularly, to a hinge mechanism of simplified construction adapted for use in association with appliances such as chest freezers or the like that include a body and a door hingedly connected thereto. Although the hinge mechanism of the present invention will be described with particular reference to use in association with a chest freezer, those of ordinary skill in the art will recognize that the invention has wider application to many other appliances, furniture, cabinetry, and elsewhere.

Conventional hinge mechanisms for chest freezers and other appliances are relatively complex, involving numerous components and assembly steps. This complexity increases the cost of the hinges, both in terms of materials and assembly labor. Also, conventional hinges for chest freezers and the like are relatively large and unsightly, and require a greater number of fasteners and include numerous internal components. Furthermore, conventional hinges for chest freezers and other applications typically rely upon tension springs in their operation, and these springs tend to reduce smoothness of operation over a wide range of motion and also decrease durability.

In the highly competitive appliance industry, low cost, pleasing aesthetics, durability, and smooth operation are highly desirable. Accordingly, a need has been found for a hinge mechanism for chest freezers and other appliances that is relatively simple so that it can be made smaller in size and less obtrusive, easier to,assemble, durable, and that operates in a smooth manner over its entire range of motion.

SUMMARY OF THE INVENTION

In accordance with the present invention, a new and improved compression spring hinge mechanism is provided. The hinge assembly includes a body adapted for connection to a first structure. A resilient member is in contact with the body, and a cam is pivotally movable relative to the body and adapted for connection to a second structure. An actuating member is positioned between the resilient member and the cam and biased by the resilient member into contact with the cam so that the actuating member exerts a force on said cam.

One advantage of the present invention resides in the provision of a compression spring hinge mechanism that is simple and easy to construct in a cost-effective manner.

Another advantage of the present invention is found in the provision of a compression spring hinge mechanism that is more aesthetically pleasing than conventional hinge mechanism.

A further advantage of the present invention is the provision of a hinge mechanism that relies upon a compression spring for biasing that provides for smooth operation over a full range of motion and increased hinge durability.

Still other benefits and advantages of the present invention will become apparent to those of ordinary skill in the art to which the invention pertains upon reading and understanding the following specification.

BRIEF DESCRIPTION OF THE DRAWINGS

The invention can take form in various components and arrangements of components preferred embodiments of which are illustrated in the accompanying drawings that form a part hereof and wherein.

DETAILED DESCRIPTION OF THE PREFERRED EMBODIMENTS

Figure 2:
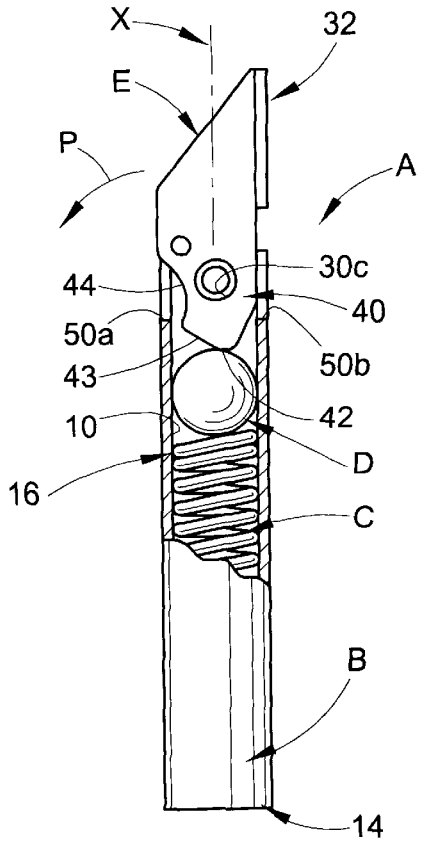
FIG. 2 is a side elevational view of the hinge mechanism of FIG. 1, with the hinge body partially broken away.

Referring now to the FIGURES, wherein the showings are for purposes of illustrating preferred embodiments only and not for purposes of limiting same, a compression spring hinge mechanism formed in accordance with the present invention is illustrated generally at A. The compression spring hinge mechanism A comprises a hinge body B that defines a preferably cylindrical bore 10 about a longitudinal axis X (FIG. 2). The body B is preferably defined entirely from a formed metallic stamping or the like, but it may also be defined from molded polymeric materials or any other suitable materials. Of course, as an alternative to the body B illustrated herein, bore 10 can be merely substantially defined by the body B so that a longitudinal slot is formed in the body B. In either case, the bore 10 is open at a first axial end 12 of the body and closely receives and retains a compression spring C, such as a conventional steel, or polymeric coil spring, or the like, therein. A second axial end 14 of the body B is closed or at least partially occluded so that the compression spring C cannot exit the bore 10 therethrough.

The body B further comprises an integral mounting flange projecting outwardly therefrom that defines one or more mounting holes 22*a* and/or mounting slots 22*b* that facilitate operative connection of the body B to an associated freezer chest F (FIGS. 5A and 5B), cabinet, or other structure using rivets, screws, or other conventional fasteners.

A metallic, polymeric, or like spherical actuating ball member D is positioned in the bore 10, in contact with a first end 16 of the compression spring C, so that the ball D is positioned axially between the first end 16 of the spring C and the first end 12 of the body B. Thus of ordinary skill in the art will recognize that the ball D is adapted for reciprocal axial movement in the bore 10.

Figure 1:
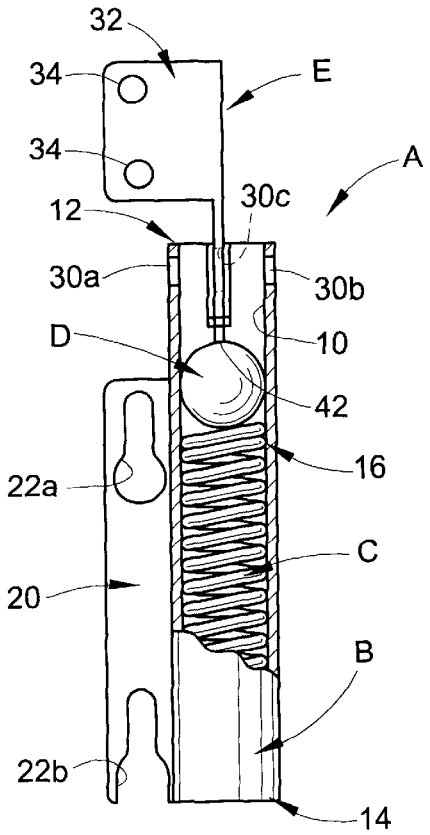
FIG. 1 is a front elevational view of a compression spring hinge mechanism formed in accordance with the present invention, with a cam member of the hinge mechanism in its first operative position and a portion of the hinge body broken away.
Figure 4:
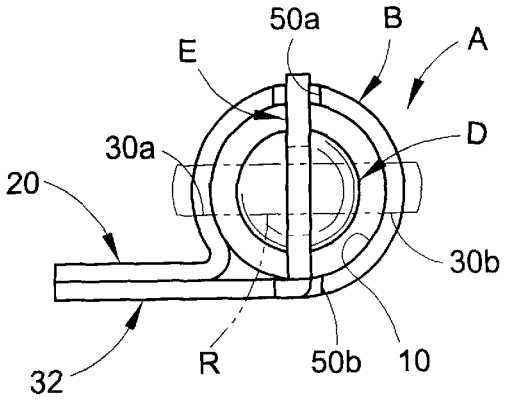
FIG. 4 is a top plan view of the hinge mechanism of FIG. 1.

The body B defines first and second transverse apertures 30*a*, 30*b* that are aligned with each other (FIGS. 1 and 4). A cam member E is pivotally connected to the first end 12 of the body B, preferably by means of a cross-pin or rivet R (shown in broken lines for clarity in FIG. 4) inserted through the aligned apertures 30*a*, 30*b*, and a corresponding aligned aperture 30*c* defined in the cam member E, itself. As will be apparent to those of ordinary skill in the art, a bushing is preferably provided in the apertures 30*a*, 30*b*, 30*c* and adapted to receive the rivet R. A first or upper part of the cam member E defines or includes a mounting flange 32 projecting outwardly therefrom that defines mounting apertures or slots 34 therein. Thus, the first, flange portion 32 of the cam member E is adapted for securement to a door, lid, or other portion of the associated appliance to which the body B is secured, such as a chest freezer F, using conventional fasteners such as rivets, screws, or the like, inserted through the apertures 34. Cam member E is preferably defined from a formed metallic stamping, that may be heat-treated or otherwise hardened, or molded polymeric material.

The cam member E also comprises a second portion 40 that depends or projects downwardly into the bore 10 when the cam member E is operatively, pivotally connected to the body B as described above. The second portion 40 of the cam member acts on the ball member D. More particularly, the second portion 40 of the cam member comprises a curved lobe portion 42 that projects outwardly and a recessed portion 44 interconnected by a flat, intermediate portion 43. The profile of the lobe portion 42 is defined such that when the cam member E is in its first operative position (FIGS. 1, 2, 5A), the lobe portion 42 exerts an axial force on the actuating ball member B that urges the ball member farthest away from the first end 12 toward the second end 14 of the body B. This, then compresses the spring member C. When compressed, the spring member C exerts an opposite biasing force on the lobe portion 42 of the cam member E through the actuating ball member D. The lobe portion 42 is defined so that the axial biasing force of the ball member D thereon urges the cam member E into its second operative position. This ensures that, when the cam member E is placed in its first operative position, the biasing force of the spring C acting on the lobe portion 42 of the cam member E through the actuating ball member D will assist movement of the cam member E toward its second operative position for purposes of facilitating opening of a door or lid connected to the cam member E as described below. Of course, those of ordinary skill in the art will recognize that the lobe portion 42 of the cam member E can be defined so that when the cam member E is placed in its first operative position, the biasing force of the spring C exerted through the ball member D inhibits movement of the cam member to its second operative position.

Figure 3:
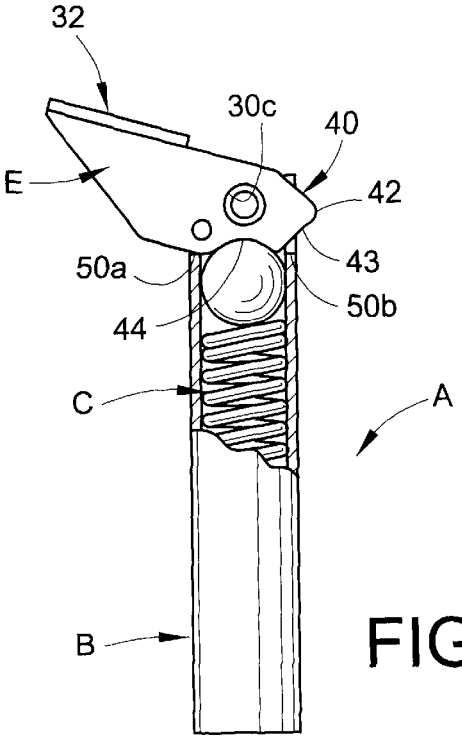
FIG. 3 is a side view similar to FIG. 2, but showing the cam mechanism of the hinge in its second operative position.

A recessed portion 44 of the cam member is connected with the lobe portion 42 by a flat or substantially flat portion 43. The recessed portion 44 is preferably defined by an arcuate surface having a radius that corresponds to the radius of the actuating ball member D. Thus, when the cam member E is pivoted to its second operative position (FIG. 3), the ball member D is closely received in the cam recessed portion 44. Receipt of the ball member D in the recessed portion inhibits pivoting of the cam member E back into its first operative position. The body B defines first and second longitudinally extending slots 50*a*, 50*b* that accommodate the cam member E when it is pivoted into its second operative position. As illustrated in FIG. 3, the slot 50*a* limits pivoting movement of the cam member E beyond its second operative position. Thus, the second operative position of the cam member E is preferably defined by receipt of the ball member D in the recessed cam portion 44, and engagement of the cam member E with the body B in the slot 50*a*.

Figure 5A:
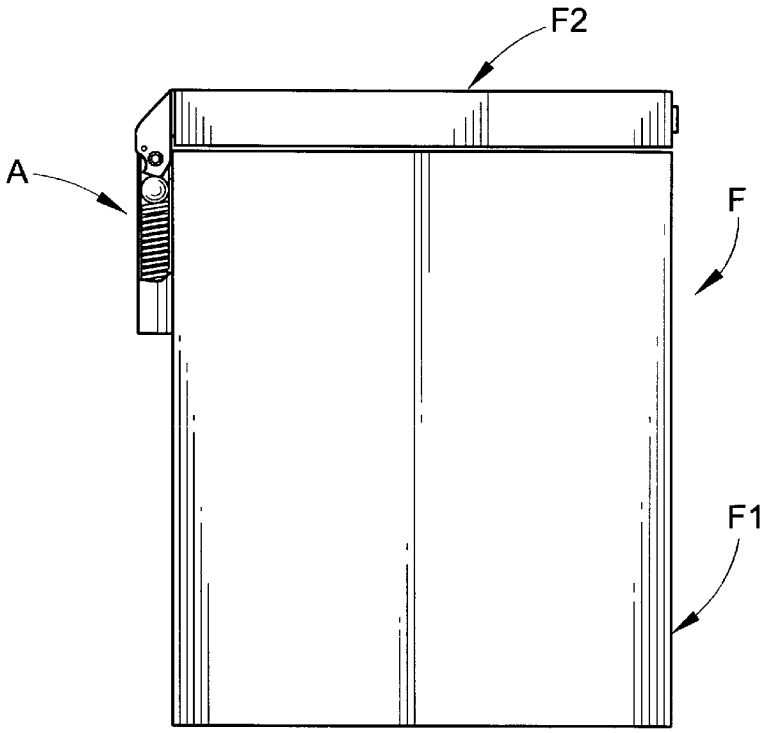
FIG. 5 is a side elevational view of a compression spring mechanism formed in accordance with the present invention installed on a chest freezer, with the cam member in its first operative position and the freezer door closed.
FIG. 5B is a view similar to 5A, but showing the cam member in its second operative position due to opening of the freezer door.
Figure 5B:
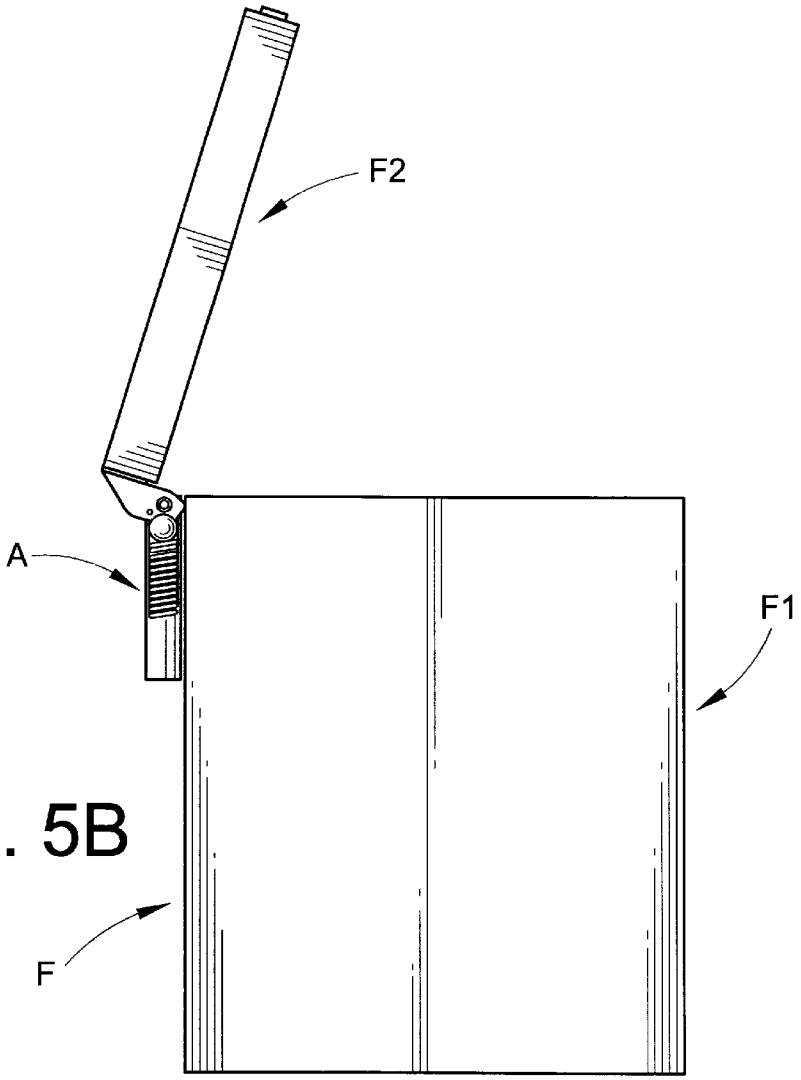

Turning now to FIGS. 5A and 5B, installation and operation of the subject hinge mechanism A will be described in further detail with reference to an associated appliance such as the illustrated chest freezer F that includes a body portion F1 and a lid or door member F2. In general, at least two of the subject compression spring hinge mechanisms A are used to hingedly secure the door F2 to the body F1 so that the door F2 is moveable between a first, closed position (FIG. 5A) and a second, opened position (FIG. 5B). The hinge body B is secured to. the freezer body F1 by way of fasteners inserted in the apertures and/or slots 22*a* , 22*b* of the body mounting flange 20. The cam member E of the hinge A is fixedly secured to the door F2 by way of one or more fasteners inserted through the apertures/slots 34 defined in the flange portion 32 of the cam member E.

In use, when the door F2 of the freezer F is in its first, closed position, the cam member E is, correspondingly, in its first operative position wherein the lobe portion 42 of the cam member E is compressing the spring C through the actuating ball member D. Again, spring member C, when compressed in this manner, urges the cam member E into its second operative position so that the door F2 of the freezer F is more easily opened.

When the freezer door F2 is partially opened, the cam member E is caused to pivot toward its second operative position. Pivoting movement of the cam member E moves the flat, intermediate cam portion 43 into engagement with the ball member D, with the intermediate portion oriented substantially perpendicular to the longitudinal axis. X of the body B. Owing to the flatness or substantial flatness of the intermediate portion 43, when the ball member D is engaged with the intermediate cam portion 43, the door member F2 will counterbalance and remain in a partially open state without support (the exact counterbalance point will vary from application-to-application depending upon door size/weight). Further, the profile of the cam E as described and illustrated, and the use of a spherical ball D, allow for smooth, uninterrupted movement of the cam member E with minimal friction or wear between these components.

Further opening of the door F2 and corresponding pivoting movement of the cam member E causes the recessed portion 44 of the cam member to move into engagement with the actuating ball member D. The close, mating relationship between the ball member D and the recessed cam portion 44, combined with the biasing force of the spring C that urges the ball axially into the recessed cam portion 44, results in these two members providing a detent mechanism that inhibits pivoting movement of the cam member E back to its first operative position. As noted above, the slot 50*a* defined in the body B limits further pivoting movement of the cam member E beyond its second operative position. The ball member D, spring C, and recessed portion 44 are selected and defined so that, for a particular door member F2, when the door member F2 is open sufficiently that the ball member D is seated in the recessed cam portion 44, the door is self-supporting and resists closing, i.e., the door is held open by the one or more hinge mechanisms A connecting it to the freezer body F1 as illustrated in FIG. 5B. Of course, the exact size and other definition of these elements will vary with each particular application of the hinge A, depending upon the number of hinges used, the size/weight of the door, and each other.

The invention has been described with reference to preferred embodiments. Of course, modifications and alterations will occur to others upon a reading and understanding of the preceding specification. It is intended that the invention be construed as including all such modifications and alterations insofar as they are encompassed by the appended claims and equivalents.

Having thus described the preferred embodiments, what is claimed is:

1. An appliance hinge assembly comprising:

a one-piece hinge body defining: (i) a mounting flange for connecting said hinge body to a first associated appliance portion; (ii) a bore; and, (iii) a stop surface;

a coil spring located in said bore;

a spherical actuating member located in said bore and urged by said coil spring toward a first end of said hinge body;

a one-piece cam member pivotably connected to said hinge body adjacent said first end, said cam member defining: (i) a first portion including a mounting flange for connecting said cam member to a second associated appliance portion; and, (ii) a second portion that extends into said bore and contacts said spherical actuating member, said second portion defining a curved lobe portion, a recessed dwell portion, and an intermediate portion interconnecting said lobe portion and said recessed dwell portion, said cam member movable pivotably relative to said hinge body between: (i) a first position where said curved lobe portion is engaged with said spherical actuating member and urges said actuating member into said bore against a biasing force of said coil spring; (ii) an intermediate position where said spherical actuating member is urged by said coil spring into engagement with said intermediate portion of said cam member; and, (iii) a second position where said cam member is engaged with said stop surface and said spherical actuating member is seated in said recessed dwell portion and biased into engagement with said recessed dwell portion by said coil spring, said actuating member, when seated in said recessed dwell portion, inhibiting movement of said cam member out of said second position, and said stop surface, when engaged with said cam member, preventing movement of said cam member away from said first position beyond said second position.

2. The appliance hinge assembly as set forth in claim 1, wherein said intermediate portion of said cam member is defined by a flat surface.

3. The hinge assembly as set forth in claim 1, wherein said spherical actuating member comprises one of a metallic spherical member and a polymeric spherical member.

4. The hinge assembly as set forth in claim 1, wherein said recessed dwell portion defines a radius of curvature that equals a radius of curvature defined by said spherical actuating member.

5. The hinge assembly as set forth in claim 1, wherein said lobe portion of said cam member is defined so that said cam member is urged by said actuating member toward said second operative position when said cam member is located in said first operative position.

6. The hinge assembly as set forth in claim 1, wherein said hinge body and said cam member are defined from respective one-piece metallic constructions.

* * * * *